US005209588A

United States Patent [19]

Chen

[11] Patent Number: 5,209,588

[45] Date of Patent: May 11, 1993

[54] COMPUTER KEY SWITCH

[76] Inventor: Pao-Chin Chen, 3F, No. 129, Sec. 5, Roosevelt Road, Taipei, Taiwan

[21] Appl. No.: 895,627

[22] Filed: Jun. 9, 1992

[51] Int. Cl.[5] ..... B41J 5/12

[52] U.S. Cl. ..... 400/490; 400/472

[58] Field of Search ..... 400/490, 495, 496, 472

[56] References Cited

U.S. PATENT DOCUMENTS 4,363,942 12/1982 Deeg et al. ..... 400/495
4,421,432 12/1983 Lieb ..... 400/495
4,773,780 9/1988 Hochgesang ..... 400/495

FOREIGN PATENT DOCUMENTS 0091284 10/1983 European Pat. Off. ..... 400/490
2124156 2/1984 United Kingdom ..... 400/490

OTHER PUBLICATIONS

Duranske, "Keyboard Assembly" Feb. 1978, IBM Technical Disclosure Bulletin, vol. 20, No. 9.

*Primary Examiner*—Edgar S. Burr
*Assistant Examiner*—Anthony H. Nguyen
*Attorney, Agent, or Firm*—Bucknam and Archer

[57] ABSTRACT

A computer key switch comprised of a key cap, a key base and a rubber cone, wherein the key cap has two bottom walls movably inserted into two elongated chambers on the key base, two hooked strips movably inserted into two opposite openings on the key base for upstroke limit control, and a plunger inserted through a ring-shaped holder on the key base and forced to squeeze the rubber cone; the key base has a bottom flange and two opposite side blocks for positioning on a frame; the rubber cone has a horn-shaped bottom ring supported on a membrane, a top ring inserted into the ring-shaped holder, a transverse division wall blocked between the top ring and the horn-shaped bottom ring, and a solid stub rod extended downwards from the transverse division wall at the center to trigger a circuit inside the membrane upon each down stroke of the plunger.

1 Claim, 3 Drawing Sheets

COMPUTER KEY SWITCH

BACKGROUND OF THE INVENTION

The keyboard in a computer system is a device for data input, which consists of a set of key. Once either key is pressed, a specific circuit is connected to produce a specific input signal. Regular computer keyboards may be gathered into two groups, one is the mechanical type and the other is the membrane type. In a mechanical keyboard, the keys can be conveniently arranged according to the layout of the printed circuit board. As illustrated in FIG. 1, the two pins of the key switch are inserted through holes on the printed circuit board and welded in place. This mechanical key switch is expensive to manufacture and simultaneously increases the total thickness of a keyboard. Furthermore, this mechanical key switch may be damaged easily because it is to trigger a signal by striking.

FIG. 2 illustrates a membrane key switch according to the prior art, in which a support is formed on a frame above a membrane and a plate to support a key cap by a rubber cone permitting the plunger of the key cap to insert through a hole the frame. This arrangement greatly reduces the total thickness of a keyboard. However, because the post is directly formed on the frame, precision is very critical and Once the layout is fixed, the arrangement of the key switches on a keyboard can no longer be changed. Therefore, the tooling charge for a membrane keyboard is very expensive, and high risk is involved in making a mold according to the desired layout. This type of membrane keyboards are commonly used for notebook computers.

SUMMARY OF THE INVENTION

The present invention has been accomplished to eliminate the aforesaid disadvantages. According to the preferred embodiment, a computer key switch is comprised of a key cap, a key base and a rubber cone. The key cap has a bottom plunger inserted through a ring-shaped holder on the key base and stopped against the rubber cone. The key base has a bottom flange and two opposite side blocks for positioning on the frame of a keyboard. The rubber cone has a horn-shaped bottom ring supported on a membrane, a top ring inserted into the ring-shaped holder and stopped against the bottom plunger of the key cap, a transverse division wall blocked between the top ring and the horn-shaped bottom ring, and a solid stub rod extended downwards from the transverse division wall at the center. Pressing the key cap causes the bottom plunger to squeeze the rubber cone, and therefore the rubber cone is forced to deform permitting the solid stub rod to trigger a circuit inside the membrane.

DETAILED DESCRIPTION OF THE PREFERRED EMBODIMENT

Figure 1:
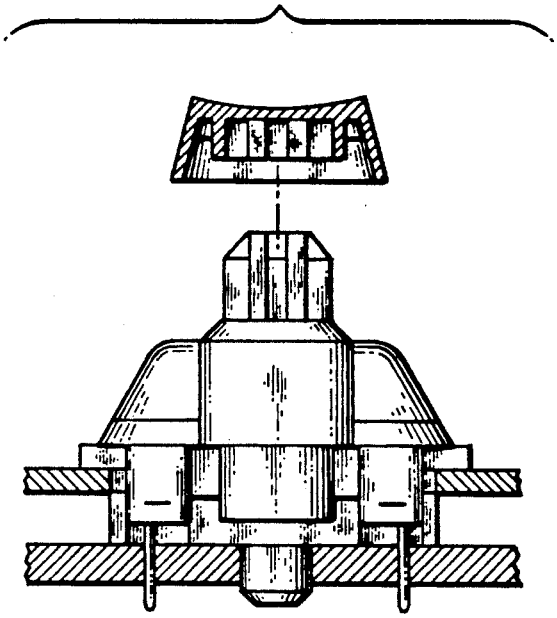
FIG. 1 (PRIOR ART)
FIG. 1 illustrates a key switch for a mechanical keyboard according to the prior art.
Figure 2:
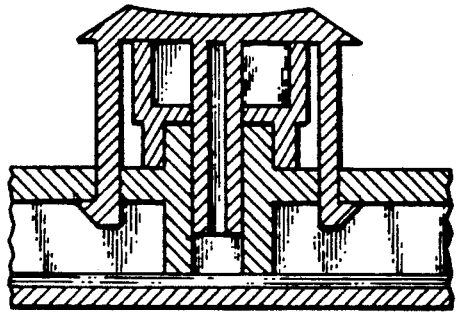
FIG. 2 (PRIOR ART)
FIG. 2 illustrates a key switch for a membrane keyboard according to the prior art.
Figure 3:
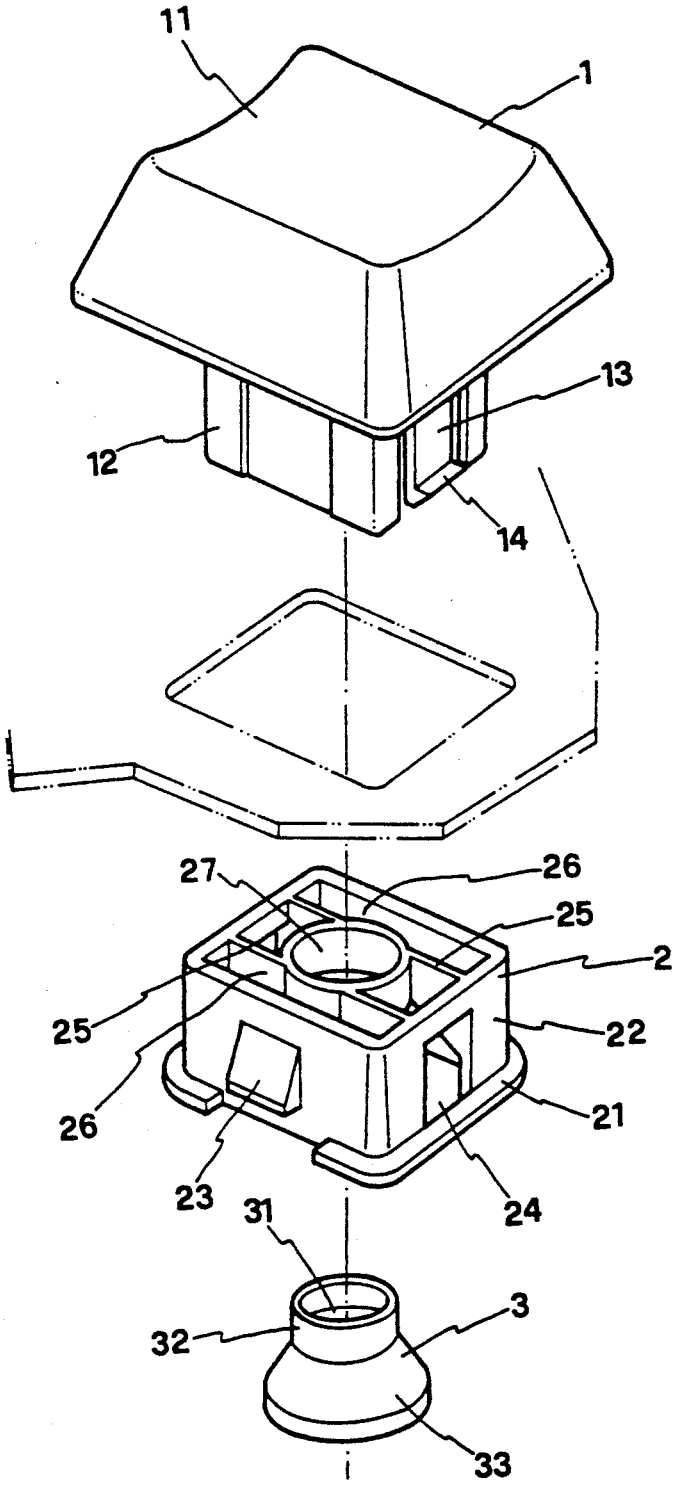
FIG. 3 is an exploded view of a key switch embodying the present invention.
Figure 4B:
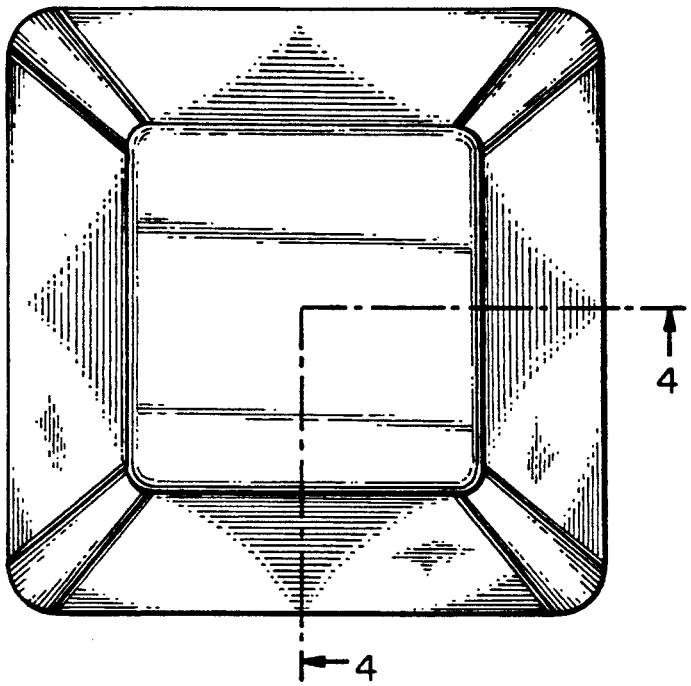
FIG. 4B is a plan view of the key switch of FIG. 3.
Figure 4A:
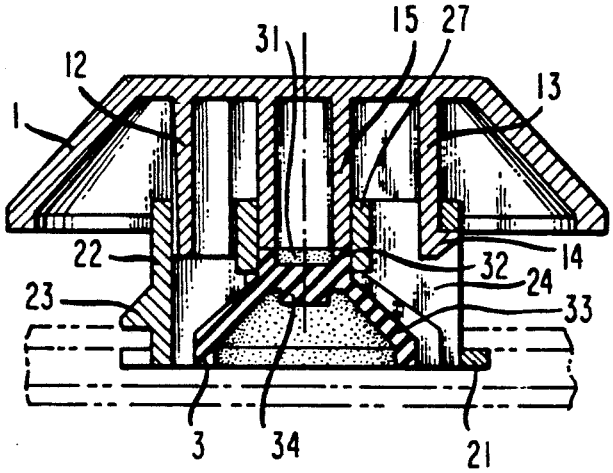
FIG. 4A is an elevational view in cross section of the key switch of FIG. 4B taken along the lines 4—4.

Referring to FIGS. 3 and 4A and 4B, a key switch as constructed in accordance with the present invention is generally comprised of a key cap 1, a key base 2, and a rubber cone 3. The key cap 1 is comprised of two opposite bottom walls 12 and two opposite bottom strips 13 vertically extended from a cap head 11 at right angles around four sides, and a hollow cylindrical plunger 15 vertically extended from the cap head 11 at the center, wherein the bottom strips 13 have each a bottom edge terminated into a hook-like bevel flange 14. The key base 2 which is made in a substantially rectangular shape comprises a bottom flange 21 around the bottom border thereof (the bottom flange 21 has two notches at two opposite sides thereof), a closed vertical surrounding wall 22 around the four sides thereof, two substantially triangle blocks 23 on the closed vertical surrounding wall 22 at two opposite sides spaced above the bottom flange 21, two openings 24 on the closed vertical surrounding wall 22 at the other two opposite sides into which the two vertical bottom strips 13 are inserted with the hook-like bevel flanges 14 thereof respectively hooked up with the transverse top edges of the openings 24, two longitudinal division walls 25 in the interior of said key base defining with the closed vertical surrounding wall 22 two spaced elongated chambers 26 for moving the two opposite bottom walls 12 of the key cap 1, and a ring-shaped holder 27 between the two longitudinal division walls 25 for receiving the hollow cylindrical plunger 15. For fitting the rubber cone 3 conveniently, the bottom edge of the ring-shaped holder 27 is formed into a substantially horn-shaped orifice. The rubber cone 3 is comprised of a top ring 32, a horn-shaped bottom ring 33, a transverse division wall 31 blocked between the top and bottom rings 32,33, and a solid stub rod 34 extended downwards from the transverse division wall 31 at the center (see FIG. 4). Squeezing the rubber cone 3 causes the horn-shaped bottom ring 33 to deform, and therefore the stub rod 34 is moved down to trigger the respective switch inside the membrane in producing a specific input signal.

Referring to FIGS. 4A and 4B again, when assembled, the top ring 32 of the rubber cone 3 fits into the horn-shaped orifice of the ring-shaped holder 27 to support the key base 2 in the frame of a keyboard above the membrane thereof; the closed vertical surrounding wall 22 of the key base 2 projects through a hole on the frame of the keyboard permitting the peripheral edge of the hole on the frame to be retained in between the bottom flange 21 and the triangular blocks 23; the bottom walls 12, the bottom strips 13 and the plunger 15 are inserted into the elongated chambers 26, the openings 24 and the ring-shaped holder 27 respectively. Therefore, pressing the cap head 11 causes the cylindrical plunger 15 to squeeze the top ring 32 of the rubber cone 3. When squeezed by the cylindrical plunger 15, the horn-shaped bottom ring 33 is forced to deform permitting the stub rod 34 to be moved downward in triggering the respective circuit inside the membrane, and therefore a specific input signal is sent by the keyboard to a computer or the like.

The arrangement of the rubber cone equally distributes the pressure from the key cap 1 through all directions and presents direct contact of the membrane, and therefore the key cap 1 is kept in course during its movement and the membrane is protected from impact force. More particularly, because the transverse division wall 31 is spaced from the topmost edge of the top ring 32, downward pressure from the cylindrical plunger 15 is transmitted through the transverse division wall 31 to force the stub rod 34 downward in triggering the respective circuit inside the membrane, and therefore less pressure is applied to the membrane. According to the present invention, the key base 2 can be arranged on the frame according to the layout of the membrane. Therefore, the present invention is suitable for making keyboards of assorted layouts at small quantity.

It is to be understood that the drawings are designed for purposes of illustration only, and are not intended as a definition of the limits and scope of the invention disclosed. For example, the key base may be directly incorporated into the frame for mass production. Therefore, it is apparent that various modifications could be made to the present invention without departing from the basic teachings thereof.

What is claimed is:

1. A key switch for a computer keyboard comprising:

a key cap, said key cap which comprises a cap head, two opposite bottom walls and two opposite bottom strips vertically extended from said cap head at right angles around the four sides of said cap head, said bottom strips having each a bottom edge terminated into a hook-like bevel flange, and a hollow cylindrical plunger vertically extending from said cap head in the center thereof;

a key base made of substantially rectangular shape fastened in a hole on a frame inside a keyboard, said key base comprising a bottom flange around a bottom border thereof, said bottom flange having two notches at two opposite sides, a closed surrounding vertical wall around the four sides thereof, two substantially triangle blocks on said closed surrounding vertical wall at two opposite sides spaced above said bottom flange for positioning on the frame of the keyboard, two openings on said closed surrounding vertical wall at the other two opposite sides into which said two vertical bottom strips are inserted, two longitudinal division walls in the interior of said key base defining with said closed vertical surrounding wall two spaced elongated chambers for receiving said two opposite bottom walls of said key cap, and a ring-shaped holder located between said two longitudinal division walls for receiving said hollow cylindrical plunger, said ring-shaped holder having a bottom edge formed into a substantially horn-shaped orifice;

said keyboard having a membrane in the interior thereof and a frame, said membrane housing a switch;

a rubber cone fastened in the interior of said keyboard below said frame and above said membrane thereof to support said key base, said rubber cone comprised of a top ring inserted into said ring-shaped holder through said horn-shaped orifice, a horn-shaped bottom ring supported on said membrane inside said keyboard, a transverse division wall blocked between said top ring and said horn-shaped bottom ring, and a solid stub rod extended downwardly from said transverse division wall at the center of said rubber cone; and wherein when said rubber cone is squeezed by said cylindrical plunger, said horn-shaped bottom ring is deformed, said stub rod is moved down to connect with a switch in the interior of said membrane, and a circuit is triggered.

* * * * *